US007384331B2

(12) United States Patent
Coulton

(10) Patent No.: US 7,384,331 B2
(45) Date of Patent: Jun. 10, 2008

(54) ROOF RIDGE VENT

(75) Inventor: Michael S Coulton, North Wales, PA (US)

(73) Assignee: Benjamin Obdyke, Inc., Horsham, PA (US)

( * ) Notice: Subject to any disclaimer, the term of this patent is extended or adjusted under 35 U.S.C. 154(b) by 0 days.

(21) Appl. No.: 11/255,532

(22) Filed: Oct. 21, 2005

(65) Prior Publication Data

US 2006/0040608 A1 Feb. 23, 2006

Related U.S. Application Data

(63) Continuation of application No. 10/684,024, filed on Oct. 10, 2003, now Pat. No. 6,981,916.

(51) Int. Cl.
*F24F 13/08* (2006.01)

(52) U.S. Cl. ..... 454/365; 454/366; 52/198; 52/199

(58) Field of Classification Search ..... 454/365, 454/364, 367, 358; 52/57, 96, 198, 199
See application file for complete search history.

(56) References Cited

U.S. PATENT DOCUMENTS

| | | | | |
|---|---|---|---|---|
| 2,200,031 | A | 5/1940 | Lee | |
| 2,214,183 | A * | 9/1940 | Seymour | 52/95 |
| 2,704,500 | A | 3/1955 | Bonforte | |
| 4,252,590 | A * | 2/1981 | Rasen et al. | 156/167 |
| 4,280,399 | A | 7/1981 | Cunning | |
| 4,325,290 | A | 4/1982 | Wolfert | |
| 4,876,950 | A | 10/1989 | Rudeen | |
| 4,942,699 | A | 7/1990 | Spinelli | 52/57 |
| 5,095,810 | A * | 3/1992 | Robinson | 454/365 |
| 5,149,301 | A | 9/1992 | Gates | 454/365 |
| 5,167,579 | A | 12/1992 | Rotter | 454/365 |
| 5,425,672 | A | 6/1995 | Rotter | 454/365 |
| 5,561,952 | A | 10/1996 | Damron | 52/198 |
| 5,603,657 | A * | 2/1997 | Sells | 454/359 |
| 5,673,521 | A * | 10/1997 | Coulton et al. | 52/199 |
| 5,704,834 | A | 1/1998 | Sells | 454/365 |
| 5,803,805 | A | 9/1998 | Sells | 454/364 |
| 5,826,383 | A | 10/1998 | Garrison | 52/198 |
| 5,902,432 | A * | 5/1999 | Coulton et al. | 156/199 |
| 5,921,863 | A | 7/1999 | Sells | 454/359 |
| 5,960,595 | A * | 10/1999 | McCorsley et al. | 52/199 |
| 6,077,159 | A * | 6/2000 | Clayton | 454/250 |
| 6,079,166 | A | 6/2000 | Mason et al. | 52/198 |
| 6,129,628 | A * | 10/2000 | O'Hagin et al. | 454/366 |
| 6,213,868 | B1 | 4/2001 | Sells | 454/359 |
| 6,298,613 | B1 | 10/2001 | Coulton et al. | 52/199 |
| 6,308,472 | B1 | 10/2001 | Coulton et al. | 52/198 |
| 6,450,882 | B1 | 9/2002 | Morris et al. | 454/365 |
| 6,612,924 | B1 * | 9/2003 | Mantyla et al. | 454/367 |
| 6,991,535 | B2 * | 1/2006 | Ciepliski et al. | 454/365 |

OTHER PUBLICATIONS

Tamko Roofing Products Technical Brochure, 2004 Tamko Roofing Products Inc.*

* cited by examiner

*Primary Examiner*—Gregory A Wilson
(74) *Attorney, Agent, or Firm*—Howson & Howson LLP

(57) ABSTRACT

A ridge vent, roof ridge vent installation, and method of installing a ridge vent is provided. Preferably, the ridge vent includes a ventilation material that has opposite longitudinally-extending sides and a longitudinally-extending central section that is transparent. The transparent central section simplifies and enables accurate placement of the vent on the roof ridge.

18 Claims, 3 Drawing Sheets

ROOF RIDGE VENT

CROSS-REFERENCE TO RELATED APPLICATION

This application is a continuation of application Ser. No. 10/684,024, filed Oct. 10, 2003.

BACKGROUND OF THE INVENTION

The present invention relates to a roof ridge vent that enhances air circulation between a roof of a building and an underlying ceiling structure, and more particularly, the present invention relates to a vent, a roof ridge vent installation, and a method of installing a vent on a roof ridge.

It is useful, and in many locales a building code requirement, that the attic area of a building be provided with a means to permit air exchange. Such ventilation prevents undue heat buildup, which can render the living quarters of the building uncomfortable and impose unreasonable energy requirements for cooling. Proper ventilation of the attic area also tends to preserve the structural integrity of the roof and roof coverings. One method of venting the roof structure consists of applying a venting media over a slot present along the ridge of a roof. These types of vents are known as ridge vents.

Examples of ridge vents are provided by U.S. Pat. No. 5,960,595 issued to McCorsley et al.; U.S. Pat. No. 6,298,613 issued to Coulton et al.; U.S. Pat. No. 6,308,472 issued to Coulton et al.; U.S. Pat. No. 5,902,432 issued to Coulton et al.; U.S. Pat. No. 5,673,521 issued to Coulton et al.; and U.S. Pat. No. 4,942,699 issued to Spinelli. These patents are owned, or co-owned, by Benjamin Obdyke, Inc., the assignee of the present application.

While the roof ridge vents disclosed in the above referenced patents function in a superior manner, there continues to be a need for further improvements with respect to roof ridge vents and their installation. To this end, an increased amount of ventilating air flow through the ridge vent is desired without compromising weather infiltration resistance. In addition, a ridge vent that can be accurately aligned over a roof ridge in a simplified and efficient manner is desired. Further, the vent should be capable of being manufactured economically.

SUMMARY OF THE INVENTION

More specifically, the present invention provides a roof ridge vent including a strip of ventilation material having a plurality of see-through openings, or windows, in a central section of the ventilation material so that the central section is substantially transparent and so that, during installation of the vent on an underlying roof ridge, the underlying roof ridge and slot are clearly visible to an installer of the vent through the transparent central section of the vent. Thus, proper alignment can be continuously verified in a simple manner during and after installation of the vent on a roof ridge.

According to another aspect of the present invention, a roof ridge vent installation is provided including the above referenced vent in combination with cap shingles and a roof having a ridge with an elongate open slot.

According to a further aspect of the present invention, a method of installing a roof ridge vent is provided. A roof ridge vent is placed over an open slot formed along a roof ridge. The roof ridge vent has a pair of longitudinally-extending outer sections that provide paths of ventilation therethrough. During installation, the open slot and roof ridge is viewed through a substantially transparent longitudinally-extending central portion of the roof ridge vent to ensure proper alignment of the roof ridge vent on the roof ridge. Thereafter, the roof ridge vent is secured to the roof ridge with nails or like fasteners.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE INVENTION

Figure 2:
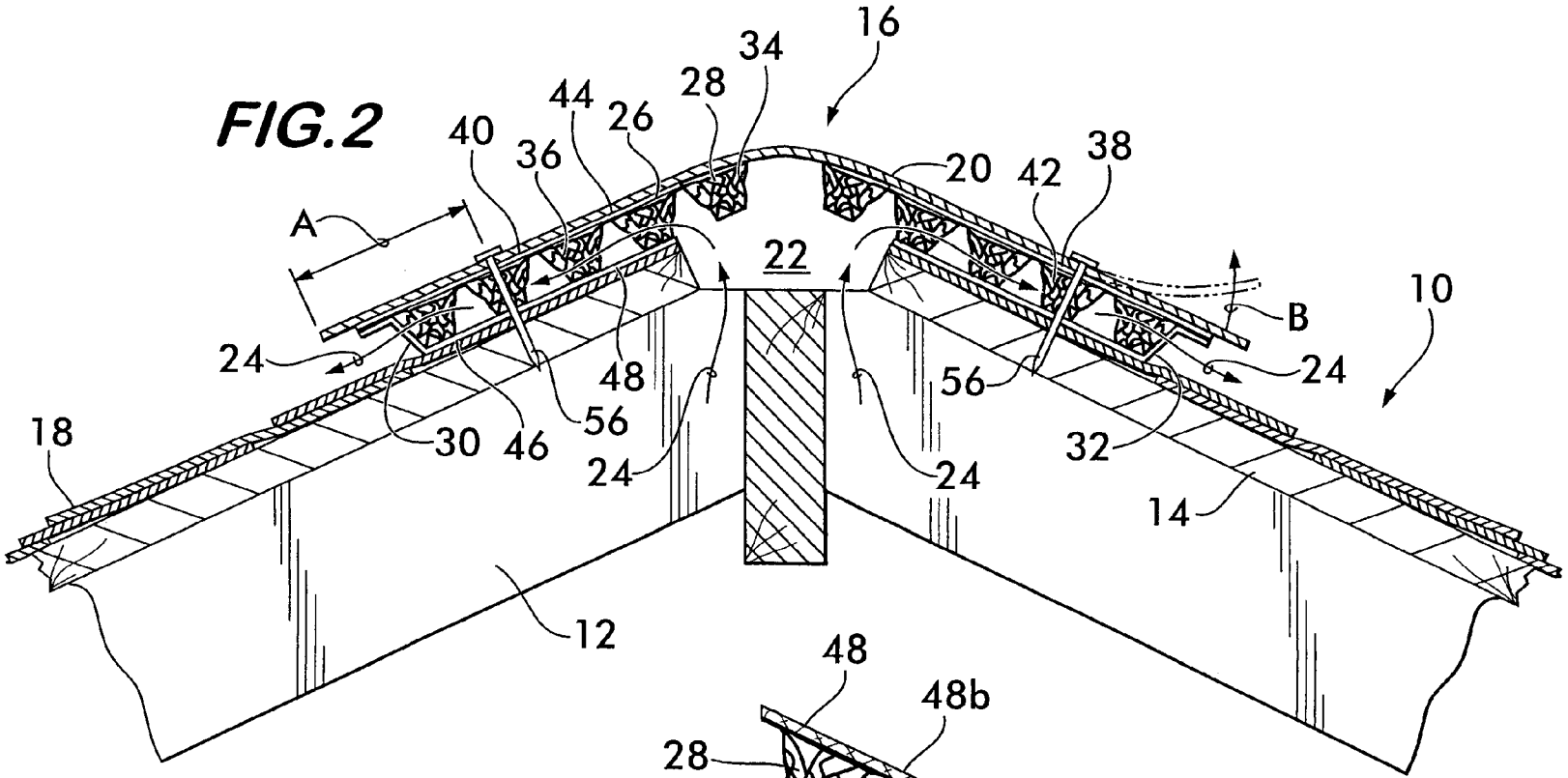
FIG. 2 is an elevational cross-sectional view of a roof ridge vent installed on a roof ridge according to the present invention.

Referring now to the drawings, FIG. 2 illustrates a roof 10 having a typical construction which utilizes a ridge vent. The roof 10 is constructed from a plurality of rafters 12 supported at their lower ends by front and rear walls (not shown) of the building. A roof deck 14 is typically constructed of plywood, or other suitable panels, to provide an outer sheathing of the building. The roof deck 14 is secured to the rafters 12, extends to the end walls, and forms a ridge, or peak, 16 therebetween. Shingles 18 are secured to the roof deck 14 to finish sloping portions of the roof 10 in accordance with conventional construction practices. Cap shingles 20 are installed overlying the ridge vent to cover the ridge 16 of the roof 10. An open slot 22 (see FIG. 2) is provided along the length of the roof ridge 16 to provide a passageway for air to vent from the underlying attic area to the ambient atmosphere as illustrated by arrows 24.

Figure 3:
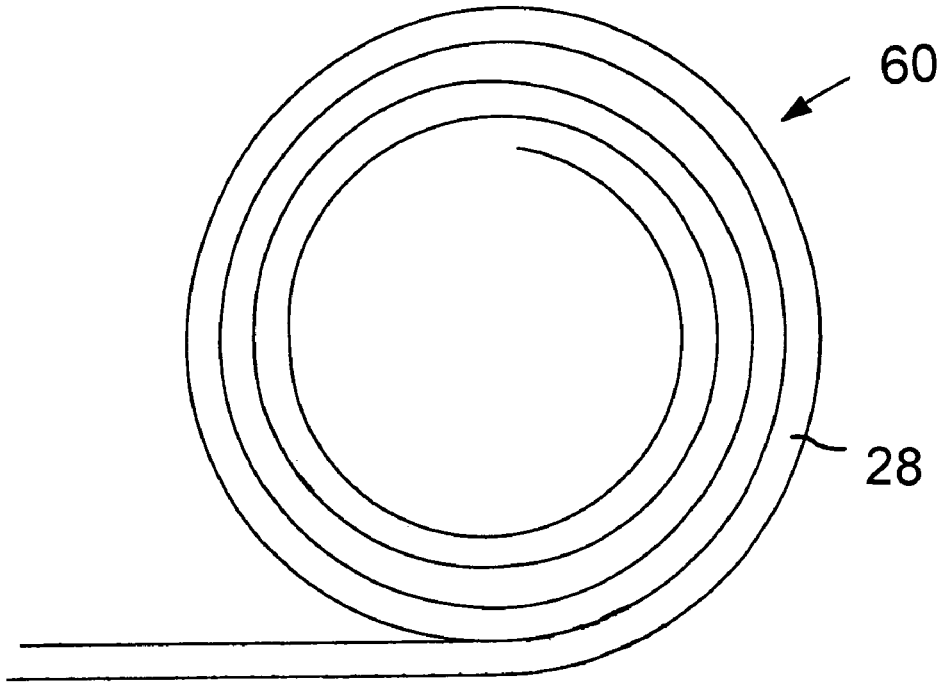
FIG. 3 is an elevational view of a spiral roll of a roof ridge vent according to the present invention.

The roof ridge vent 26 according to the present invention is made of a continuous, elongate strip of a ventilation material 28 that provides a plurality of ventilation passageways enabling air to vent from the open slot 22 formed in the roof 10 to and through a pair of longitudinally-extending outer peripheral side edges, 30 and 32, of the vent 26. The specific type of openwork material used as the ventilation material 28 in the vent 26 can be of various forms. For example, a preferred material is an indeterminate-length mat 34 of randomly convoluted polymeric filaments formed with a plurality of cusps, or hollow spacer elements, 36 as disclosed in U.S. Pat. Nos. 5,960,595 and 6,298,613, the disclosures of which are incorporated herein by reference. The layout, or pattern, of the cusps 36 is designed to resist compression of the vent 26 during and after installation and to afford ready rolling and unrolling of the vent 26 during manufacture and installation. Alternative ventilation materials (not shown) include fibrous mats without cusps, thermoplastic webs with hollow spacer elements, and materials having defined passageways formed therein such as corrugated materials. Preferably, the ventilation material 28 is such that it can be rolled lengthwise into a spiral roll 60 see (FIG. 3) during manufacture and stored, transported and supplied to installers in roll-form.

The ventilation material 28 has a longitudinally-extending central section 38 between a pair of longitudinally-extending outer sections, 40 and 42. In the illustrated embodiment, the cusps, or hollow spacer elements, 36 are disposed in a plurality of longitudinal rows extending the length of the ventilation material 28, and the outer sections, 40 and 42, are defined as including the outermost three rows of cusps 36. See FIG. 1. The ventilation material 28 also has an upper face 44 and a lower face 46 that extend across the central and outer sections, 38, 40 and 42. During installation, the ventilation material 28 is provided with an inverted V-shaped transverse cross-section in which the outer sections, 40 and 42, are disposed at a dihedral angle relative to one another as best illustrated in FIG. 2 to conform to the surface of the roof ridge 16.

Preferably, at least a portion of the surface of the ventilation material 28 is attached to and covered by air permeable filter material 48 that permits air to flow outwardly in the manner illustrated by the arrows 24 in FIG. 2 and that prevents rain, snow, blowing foreign objects, insects and the like from entering into the vent 26 through and/or adjacent the side edges, 30 and 32, of the vent 26 in a direction opposite to that shown by arrows 24. The air permeable filter material 48 can be, for instance, a sheet-like fabric of non-woven nylon polyester, a needle-punched non-woven material, a metal mesh screen, or any like material that provides air permeability through small spaces in their structure. Preferably, the air permeable filter material 48 is thermally or adhesively bonded to the ventilation material 28 and extends across the side edges, 40 and 42, and selected regions of the upper and lower faces of the ventilation material 28.

Figure 2A:
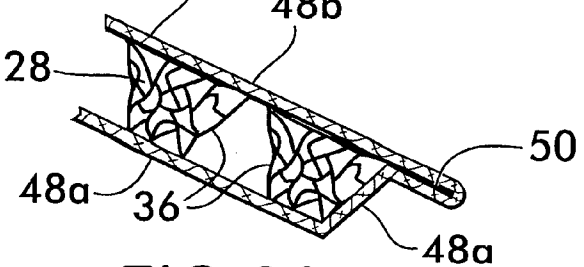
FIG. 2A is a cross-sectional view of a side edge of an alternate roof ridge vent according to the present invention.

In the illustrated embodiments, the side edges 30 and 32 of the vent 26 is formed by an outermost row of cusps 36 covered by a layer of air permeable filter material 48*a*. Preferably, an edge flange 50 extends outwardly from side edges 30 and 32 along the upper face 44 of the ventilation material 28. The air permeable filter material 48*a* is bonded to the underside of the edge flange 50 and along the lower face 46 of the ventilation material to ensure that air permeable filter material 48*a* spans completely across each side edge, 30 and 32. A separate piece of air permeable filter material 48*b* extends on the upper face 44 of the ventilation material 28. Alternatively, as illustrated in FIG. 2A, the air permeable filter material 48*a* and 48*b* can be a single strip of material that is folded around the edge flange 50.

Figure 1:
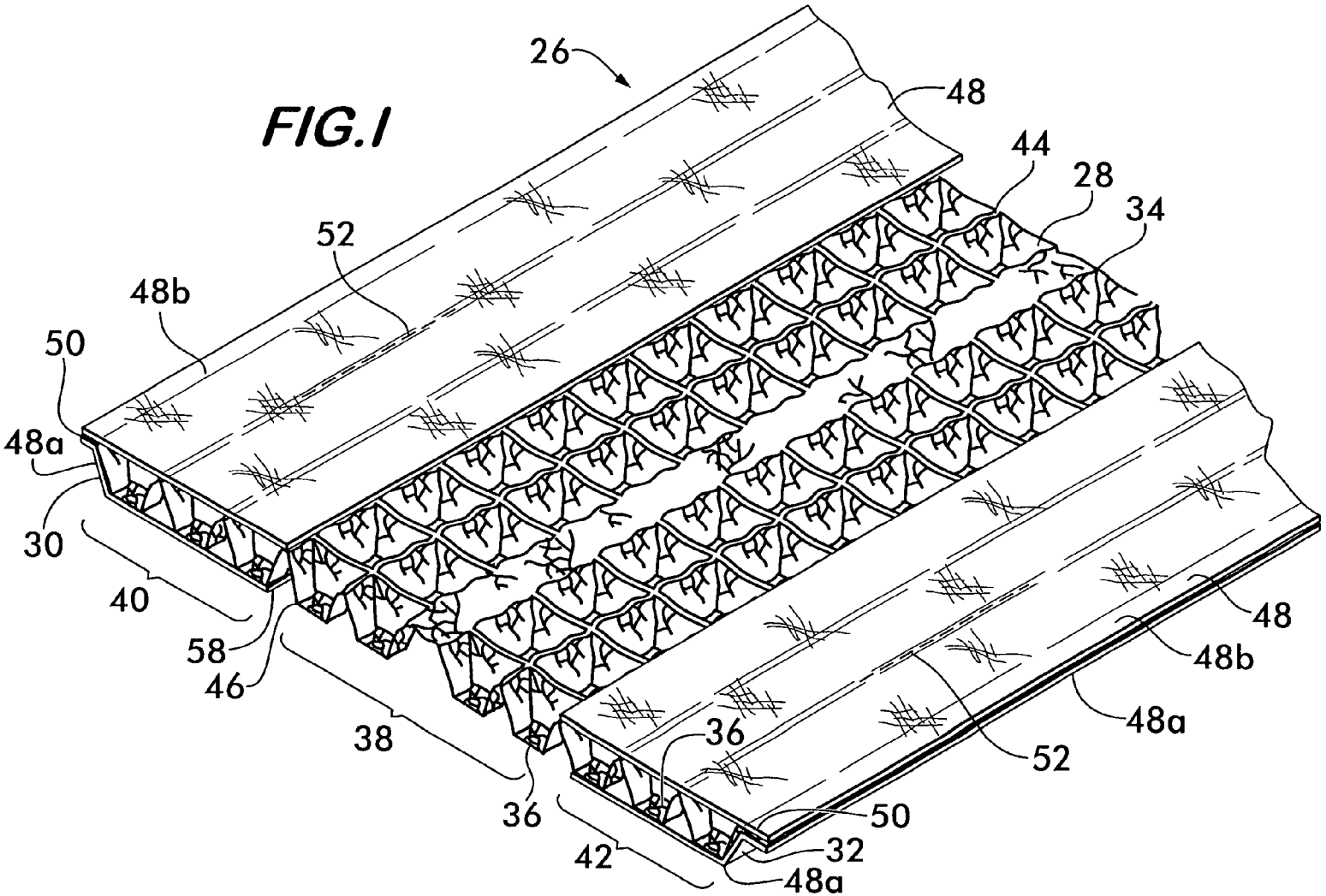
FIG. 1 is a perspective view of an unrolled roof ridge vent embodying the present invention.

As best illustrated in FIG. 1, nail lines 52 and 54 are identified on the upper face of the vent 26 for aiding proper placement of nails 56 by the installer. The nail lines 52 and 54 extend a spaced distance "A" from the side edges, 30 and 32. During windy conditions, it is possible for a section 20*a* of the cap shingle 20 extending outwardly from nail 56 to deflect upward in a direction "B". For example, see FIG. 2. Thus, to ensure the formation of a proper weather infiltration barrier, the air permeable filter material 48*b* on the upper face 44 of the ventilation material 28 extends continuously from the edge flange 50 to beyond the adjacent nail line, 52 or 54. For example, the nail lines 52, 54 may be adjacent the second outermost rows of cusps 36 and the air permeable filter material 48*b* may extend over the outer three or four outermost rows of cusps 36 as illustrated in FIGS. 1 and 2.

Air permeable filter material 48*a* extends on the lower face 46 of the ventilation material to an extent at least beyond intended nail lines, 52 and 54 so that the material extends inward of the nails 56 as installed as shown in FIG. 2. This should ensure the prevention of weather infiltration adjacent the lower face 46 of the vent 26. Preferably, the inward edge 58 of air permeable filter material 48*a* terminates at a location such that it does not extend over the open slot 22 formed in the roof ridge 16. See FIG. 2. Thus, the ventilating air illustrated by arrow 24 only makes a single pass through the filter material 48 when passing through the ridge vent 26. This permits an increase in the amount of air flow through the open slot 22 and vent 26 and into the ambient atmosphere. In addition, since the inward edge 58 of the air permeable filter material 48*a* terminates short of the open slot 22, the air permeable filter material 48*a* is prevented from wicking moisture to the open slot 22.

As discussed above, the air permeable filter material, 48*a* and 48*b*, does not extend completely across the upper and lower faces 44 and 46 of the ventilation material; rather, the upper and lower faces 44 and 46 of the central section 38 of the ventilation material 28 remain exposed and uncovered. This provides the central section 38 with a transparent, or "see-through", property and enables easier installation with more accurate alignment of the ridge vent 26 on the roof ridge 16. To this end, the preferred embodiment has a ventilation material made of a thin layer of randomly convoluted polymeric filaments formed with hollow cusps 36. Numerous openings are present between filaments thereby providing a central section 38 that is substantially transparent. To this end, the central section 38 is transparent to the same extent that a window screen is transparent. Thus, the central section can be seen through so that, as the vent 26 is being installed on the roof ridge 16, the roof ridge 16 and open slot 22 is clearly visible to the installer through the central section 38. Adjustments to the positioning of the vent 26 on the roof ridge 16 can be made prior to installing each nail 56.

A vent 26 with a see-through central section 38 is not limited to vents made of convoluted filaments. Rather, various alternatives providing a see-through central section of a vent can be utilized. For example, if the ventilation material 28 is solid, it can be provided with openings to provide a see-through window or it can be made, at least partially, with a transparent material, such as, a transparent plastic material, a mesh screen, or the like. In addition, non-rollable sectional ridge vents can also be provided with see-through central sections.

By way of example, and not by way of limitation, the ridge vent 26 can be made of an elongate openwork mat of randomly convoluted polymeric filaments such that the vent has a width of about 10.5 inches and a thickness of about ⅝ of an inch. The filaments can be molded to form eight uniform and longitudinally-extending rows of cusps 36, and a nail line 52 and 54 can be identified adjacent each side edge, 30 and 32, between each pair of outermost rows of cusps. An air permeable filter fabric 48*b* can extend continuously on the upper face 44 of the vent 26 from each edge flange 50 over the first two outermost rows of cusps 36. An air permeable filter fabric 48*a* can extend continuously from an underside of each edge flange 50 across the adjacent side edge, 30 or 32, and on the lower face 46 of the vent 26 over the first three outermost rows of cusps 36. Thus, at least the central two rows of cusps are exposed and uncovered and provide a transparent viewing window to objects on the other side of the vent 26.

A method of installing a ridge vent 26 according to the present invention includes placing an elongate strip of openwork, or ventilation, material 28 over an open slot 22 formed along a roof ridge 16. Preferably, the openwork material 28 is provided in a spiral roll, is unrolled lengthwise on the roof ridge 16, and has a longitudinally-extending central section that is transparent. Thus, the method according to the present invention includes viewing and visually inspecting alignment of the vent 26 with the roof ridge 16. Adjustments to the placement of the vent can be made before sinking each nail through the vent and into the roof deck. In this manner, precise centering of the vent 26 on the roof ridge 16 can be readily accomplished with a minimum of skill and effort.

Preferably, the openwork material is partially covered with an air permeable filter material, or fabric, 48 as discussed above. Thus, the method of installing and aligning the vent 26 includes the step of ensuring that the air permeable filter material 48 does not overlie the open slot 22. The method also includes securing cap shingles over the vent 26 along a pair of nail lines, 52 and 54, such that the air permeable material 48*b* extending on the upper face 44 of the vent 26 extends continuously from each side edge, 30 and 32, to beyond each adjacent nail line, 52 and 54, respectively.

The above-described roof ridge vent, roof ridge vent installation and method of installing a roof ridge vent according to the present invention provides a roll-form vent which is easy to install, inexpensive to manufacture, and provides increased air flow therethrough.

While a preferred roof ridge vent, roof ridge vent installation and method of installing a roof ridge vent have been described in detail, various modifications, alterations, and changes may be made without departing from the spirit and scope of the vent according to the present invention as defined in the appended claims.

The invention claimed is:

1. A roof ridge vent comprising a strip of ventilation material having a pair of longitudinally-extending outer sections that provide paths of ventilation therethrough and a longitudinally-extending central section extending between said pair of longitudinally-extending outer sections, said ventilation material being positionable in a shape that conforms to a shape of an underlying roof ridge in which said outer sections are disposed at a dihedral angle relative to one another on opposite sides of a slot formed in the roof ridge, and said central section having at least one opening permitting an underlying roof ridge and slot to be visible through said central section during installation of said vent on a roof ridge.

2. A roof ridge vent according to claim 1, wherein said roof ridge vent is a sectional roof ridge vent.

3. A roof ridge vent according to claim 1, wherein said roof ridge vent is a continuous rollable roof ridge vent that is supplied in a spiral roll.

4. A roof ridge vent according to claim 1, wherein said central section of said roof ridge vent is solid except for a plurality of said openings formed therein providing see-through windows.

5. A roof ridge vent according to claim 4, wherein said ventilation material has a face and a plurality of spacer elements extending therefrom.

6. A roof ridge vent according to claim 5, wherein said ventilation material is thermoplastic.

7. A roof ridge vent according to claim 1, wherein said ventilation material is a corrugated material.

8. A roof ridge vent installation comprising a roof having a ridge with an elongate open slot, a ridge vent secured to said roof overlying said ridge and open slot, and cap shingles secured to said roof and overlying said ridge vent, said vent having a pair of longitudinally-extending outer sections that provide paths of ventilation therethrough and a longitudinally-extending central section having see-through openings that enable said underlying roof ridge and slot to be visible through said central section of said ridge vent during installation of said vent on said roof ridge.

9. A roof ridge vent according to claim 8, wherein said roof ridge vent is a sectional roof ridge vent.

10. A roof ridge vent according to claim 8, wherein said roof ridge vent is a continuous rollable roof ridge vent that is supplied in a spiral roll.

11. A roof ridge vent according to claim 8, wherein said central section of said roof ridge vent is solid except for said openings formed therein.

12. A roof ridge vent according to claim 8, wherein said ventilation material is thermoplastic.

13. A roof ridge vent according to claim 8, wherein said ventilation material is a corrugated material.

14. A roof ridge vent according to claim 8, wherein said ventilation material has a plurality of spacer elements extending from a face thereof.

15. A method of installing a roof ridge vent, comprising the steps of:

placing a roof ridge vent over an open slot formed along a roof ridge, said vent having a pair of longitudinally-extending outer sections that provide paths of ventilation therethrough and a longitudinally-extending central section having see-through openings;

viewing the open slot and roof ridge through said see-through openings of said central section of said roof ridge vent; and securing said roof ridge vent to said roof ridge after said viewing step.

16. A method according to claim 15, wherein said roof ridge vent is a sectional vent.

17. A method according to claim 16, wherein said central section of said roof ridge vent is solid except for said openings formed therein.

18. A method according to claim 15, wherein said roof ridge vent is supplied in a spiral roll and is unrolled before said viewing and securing steps.

* * * * *